United States Patent [19]

Foreman

[11] Patent Number: 4,653,232

[45] Date of Patent: Mar. 31, 1987

[54] APPARATUS FOR SHARPENING A PLURALITY OF TOOLS

[76] Inventor: Roscoe C. Foreman, 210 Radio Blvd., Carlsbad, N. Mex. 88220

[21] Appl. No.: 789,448

[22] Filed: Oct. 21, 1985

[51] Int. Cl.[4] ..... B24B 9/00

[52] U.S. Cl. ..... 51/46; 51/34 H; 51/36; 51/75; 51/216 R; 51/217 T

[58] Field of Search ..... 51/46, 34 H, 36, 48 HE, 51/91 BS, 92 BS, 240 R, 75, 95 LH, 216 R, 216 T, 217 R, 217 T; 269/246, 249, 88

[56] References Cited

U.S. PATENT DOCUMENTS

| | | | |
|---|---|---|---|
| 693,811 | 2/1902 | Yonge | 269/258 |
| 1,389,760 | 9/1921 | Humbert | 269/246 |
| 1,409,641 | 3/1922 | Anderson | 51/48 HE |
| 2,247,479 | 7/1941 | Caldwell | 51/34 F |
| 2,718,097 | 9/1955 | Bradley | 51/48 HE |
| 3,045,398 | 7/1962 | McEwan | 51/48 HE |
| 3,864,877 | 2/1975 | Doll | 51/48 HE |
| 4,415,149 | 11/1983 | Rees | 269/88 |

*Primary Examiner*—Frederick R. Schmidt

*Assistant Examiner*—Bradley I. Vaught

*Attorney, Agent, or Firm*—Marcus L. Bates

[57] ABSTRACT

An apparatus for sharpening a plurality of tools. The apparatus includes a tool holder for receiving a plurality of tools to be sharpened. The tools are held in the holder with the cutting edges thereof aligned with respect to the longitudinal axis of the holder and in side by side relationship respective to one another. A grinding wheel is mounted to be moved parallel to the longitudinal arranged cutting faces of the tools and removes metal therefrom to thereby resharpen the cutting edges thereof. Means are provided by which the rotating grinding wheel can be moved towards and away from the cutting faces of the tools to thereby enable proper adjustments to be made between the cutting edge of the tools and the contact area with the grinding wheel. The tool holder can be rotated about the longitudinal axis centerline thereof to adjustably position the cutting edge of the tools in a manner which enables the cutting edge of the tools to make proper contact with the grinding wheel and thereby provide the most optimum cutting edge on each of the tools.

2 Claims, 9 Drawing Figures

APPARATUS FOR SHARPENING A PLURALITY OF TOOLS

BACKGROUND OF THE INVENTION

Proper sharpening of tools, such as jointer blades, chisels, and lawn mower blades can restore the cutting edge of the tools to a condition equal to or better than the original cutting edge provided by the manufacturer if the sharpening operation is carried out with great skill and with the proper equipment. Most people, however, do not have the proper equipment for achieving a like-new cutting edge on a worn cutting implement. Furthermore, very few people have developed the talent of resharpening tools to the extent that they can manually hold the tool to be sharpened and manipulate the tool respective to a rotating grinding wheel and achieve a superior cutting edge.

Tool grinders for resharpening cutting implements are known to those skilled in the art as evidenced by the following patents:

| | |
|---|---|
| 222,539 | 2,183,995 |
| 1,060,170 | 2,705,391 |
| 1,197,619 | 3,735,533 |
| 1,493,346 | 4,052,174 |

The present invention constitutes an improvement over the above recited prior art in that a tool grinder with attachments therefor is provided by which the average person with very little training can properly mount several tools to be sharpened into a special tool holder, adjust the relative position of a grinding wheel respective to the tools to be sharpened, properly orient the cutting edge of the tools respective to the grinding wheel, and thereafter achieve a cutting edge on the plurality of tools that is equal to or better than the original cutting edge provided by the manufacturer.

SUMMARY OF THE INVENTION

Tool sharpening apparatus by which the cutting edge of a plurality of tools can be dressed so that the cutting edge thereof is restored to a satisfactory cutting condition. A tool holder releasably receives the tools. The cutting edges of the individual tools are oriented to lie along a common longitudinally extending line. A rotating grinding wheel is positioned for movement towards the tool holder and also parallel to the common longitudinally extending line. The tool holder can be rotated axially along a line parallel to and spaced from the longitudinally extending line. The tool holder and the grinding wheel are mounted for movement to a main frame by means of a slide assembly.

The slide assembly includes spaced slide members which are slidably received by spaced guide members. The guide members are affixed to a main frame. A lower plate member is affixed to the slide members. Means are provided for movement of the slide members along the guide members and thereby effect longitudinal movement into the lower plate member respective to the tool holder.

The slide assembly includes an upper plate member mounted for movement respective to the lower plate member. Movement of the upper plate member effects lateral movement between the grinding wheel and the tool holder.

The grinding wheel is mounted to the plate member, and relative movement of the upper and lower plate members provide for the above described movement of the grinding wheel respective to the cutting edge of the tools held by the tool holder.

The tool holder is comprised of an elongated member having bracket means at opposed ends thereof by which the tool holder is mounted to the main frame in an axially rotatable manner. Fastener means are provided by which the tool holder is secured against rotation.

The tool holder includes spaced parallel faces interrupted by a longitudinal vertical flange member. A movable clamp member is threadedly secured to the tool holder and forms a clamp between the confronting faces of the flange and clamp member between which the plurality of tools are releasably received.

The first and second plate members are moved respective to one another by a threaded screw which has an end attached to the first plate member and a threaded bracket attached to the second plate member so that rotation of the screw effects relative movement between the first and second plate members, and moves the grinding wheel towards the tool holder.

The first plate member is moved respective to the main frame by a screw threadedly received by a bracket. The bracket is attached to the main frame and the end of the screw is attached to the first plate member so that rotation of the screw moves the grinding wheel along a path which is parallel to the tool holder.

In another embodiment of the invention, the first plate member is moved respective to the frame by a windless means.

A primary object of this invention is the provision of a tool sharpener for simultaneously sharpenihg a plurality of tools.

Another object of this invention is the provision of a tool sharpener having a tool holder within which a plurality of tools are removably mounted in a manner which enables the cutting edges thereof to be aligned along a common line.

A still further object of this invention is the provision of a tool sharpener having a tool holder and a grinding wheel mounted to a frame and arranged whereby a plurality of tools are releasably held oriented in an optimum position respective to the surface of the grinding wheel.

An additional object of the present invention is the provision of a tool sharpener having a tool holder and grinding wheel adjustably mounted to a frame, wherein the tool holder receives a plurality of tools thereon, while the grinding wheel can be moved along the cutting faces of the tools in a manner to renew the cutting edge of all the tools in a single operation.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
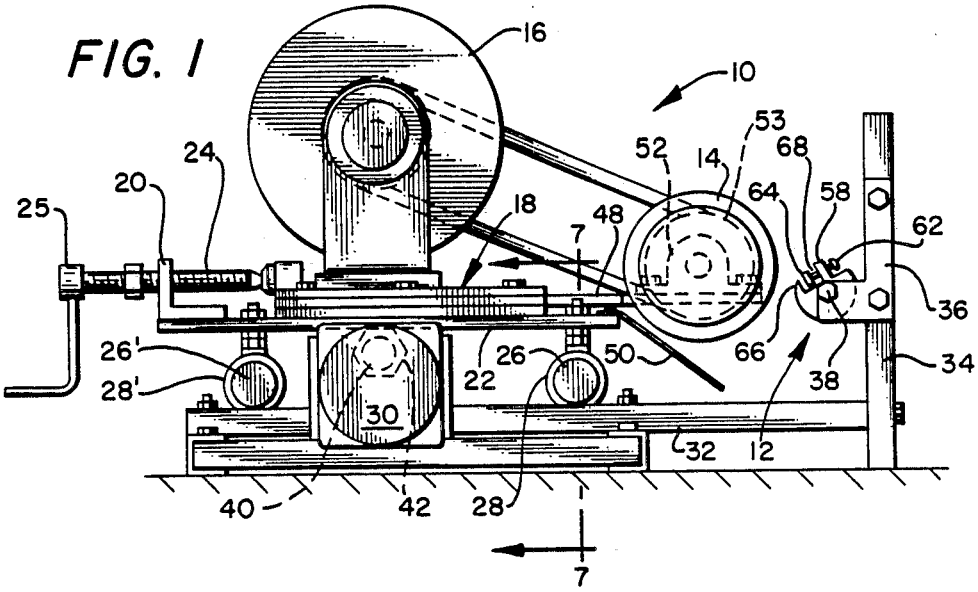
FIG. 1 is a side elcvational view of a tool grinder made in accordance with the present invention.

In the figures of the drawings, there is disclosed a tool sharpenihg apparatus 10 for simultaneously grinding a new cutting face or cutting edge onto a plurality of tools such as chisels, lawn mower blades, jointer blades, and planer blades for example. The apparatus 10 includes a tool bar 12, made in accordance with this invention, which releasably captures a number of tools of different configurations, in a manner which aligns the cutting faces of the tools along a common line. A grinder wheel 14 is spaced from the tool bar and driven by motor 16. The grinder wheel 14 and motor 16 are mounted to a slide assembly 18 which enables the grinding wheel to be moved in either of two directions which is perpendicular and parallel respective to the longitudinal axis of the tool bar 12.

A bracket 20 is affixed to a movable lower plate member 22. The bracket 20 threadedly receives a screw 24. The screw 24 has a free end connected to actuator handle 25, with the other end thereof being attached in a captured manner to an upper plate member 48 so that as the handle 25 is rotated, the screw 24 moves the plate member 48, and thereby moves the grinding wheel 14 towards and away from the tool bar 12.

A pair of parallel, spaced guide bars 26, 26' slidably receive sleeves 28, 28' thereon so that the sleeves are reciprocated in a slidable manner respective to the guide bar. The slidable lower plate member 22 is affixed to the sleeves 28, 28' and move therewith in a direction parallel to the longitudinal axis of the tool bar 12.

Motor 30 is connected to a reduction gear box, which in turn is connected to a drive train for moving the lower plate member 22 and thereby moving the motor 16 and grinder 14 longitudinally of the tool bar.

A main frame 32 includes spaced horizontal members to which there is connected the illustrated spaced vertical frame members 34. L brackets 36 are attached to the vertical frame members 34 and are releasably connected at the opposed ends of the tool bar 12 by means of opposed bolts 38.

Figure 2:
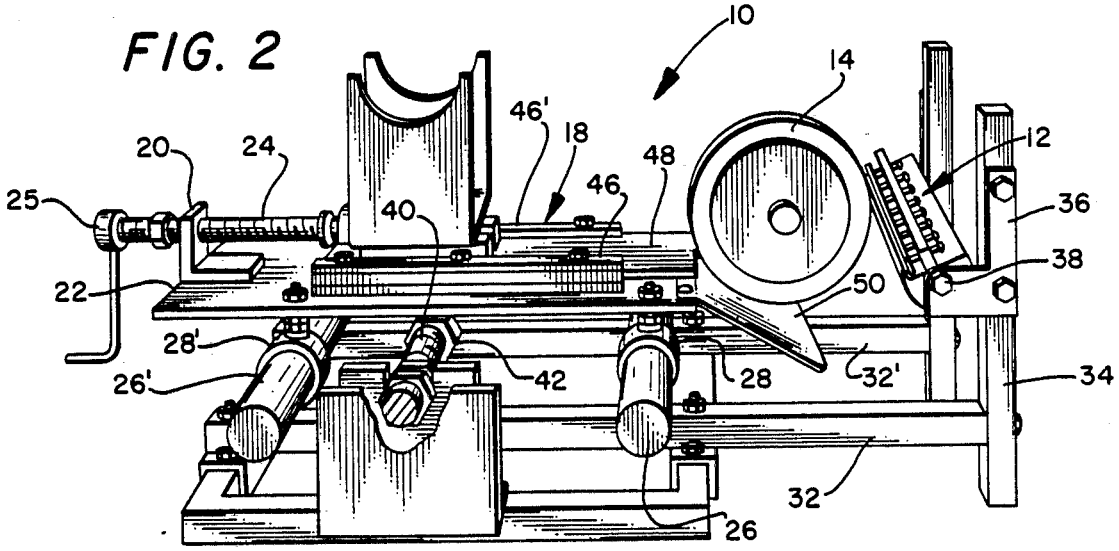
FIG. 2 is a perspective view of the tool grinder seen in FIG. 1, with some parts thereof being removed therefrom so as to fully disclose the otherwise hidden details.

As best seen in FIG. 2, together with other figures of the drawings, a shaft 40 is located between guide bars 26, 26' and arranged parallel thereto. The shaft 40 has a threaded surface formed thereon which threadedly engages a threaded housing 42. The housing 42 is attached to the lower plate member 22. One end of the threaded shaft 40 is journaled to the main frame while the other end thereof is connected to the output shaft of the gear box driven by the motor 30.

Figure 7:
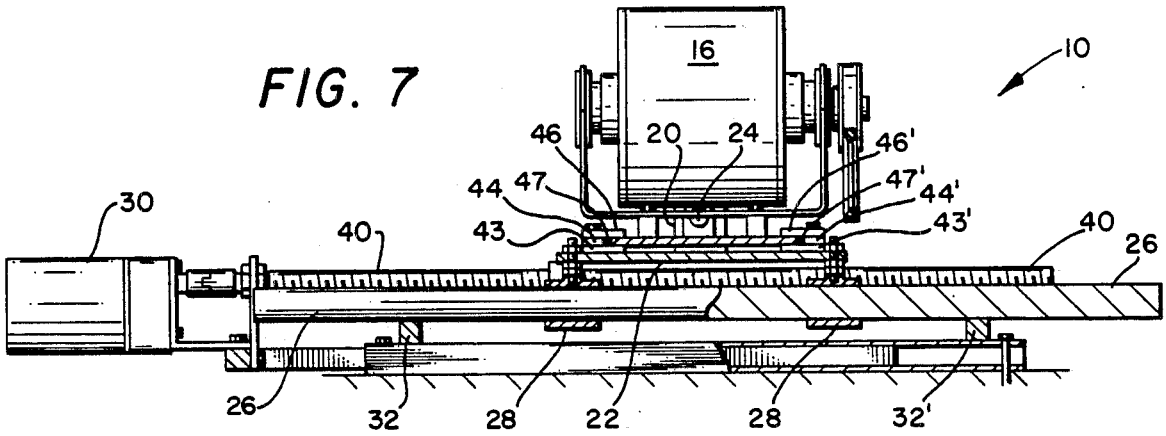
FIG. 7 is a cross sectional view taken along line 7—7 of FIG. 1.

As seen in various figures of the drawings, and in particular FIGS. 1, 2, and 7, the slide assembly 18 for motor 16 and grinder 14 includes lower spacer member 43 located in fixed relationship respective to the plate lower member 22, a narrow intermediate spacer 44, and an upper spacer member 46. Members 43 and 46 are therefore spaced apart by means of narrow spacer 44 an amount to admit the upper plate 48 to be reciprocatingly received in a slidable manner within the opposed parallel grooves 47 formed between members 43 and 46.

Figure 3:
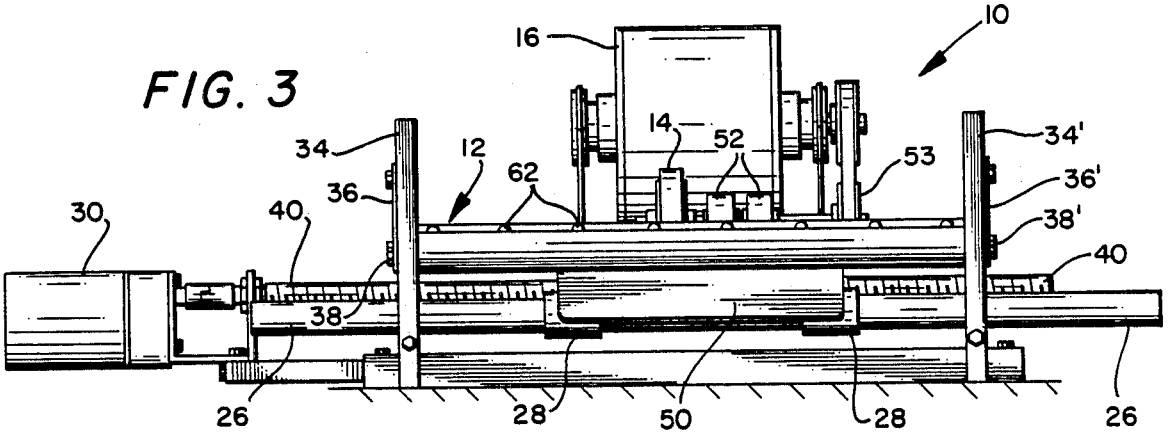
FIG. 3 is an end view of the apparatus seen in FIGS. 1 and 2.

In FIGS. 1–3, a shield 50 has a fixed end connected to one end of lower plate member 22, and an upper surface which underlies grinding wheel 14 and thereby forms a bearer which procludes the residue from the grinding operation from contaminating some of the vital parts of the apparatus 10 or 110.

The grinder wheel 14 is rotatably supported from upper plate member 48 by means of journals 52. Pulley 53 is connected to the illustrated output pulley of motor 16. The motor is provided with suitable prior art electrical conduits and switch means, the details of which can take on several different forms.

Figure 4:
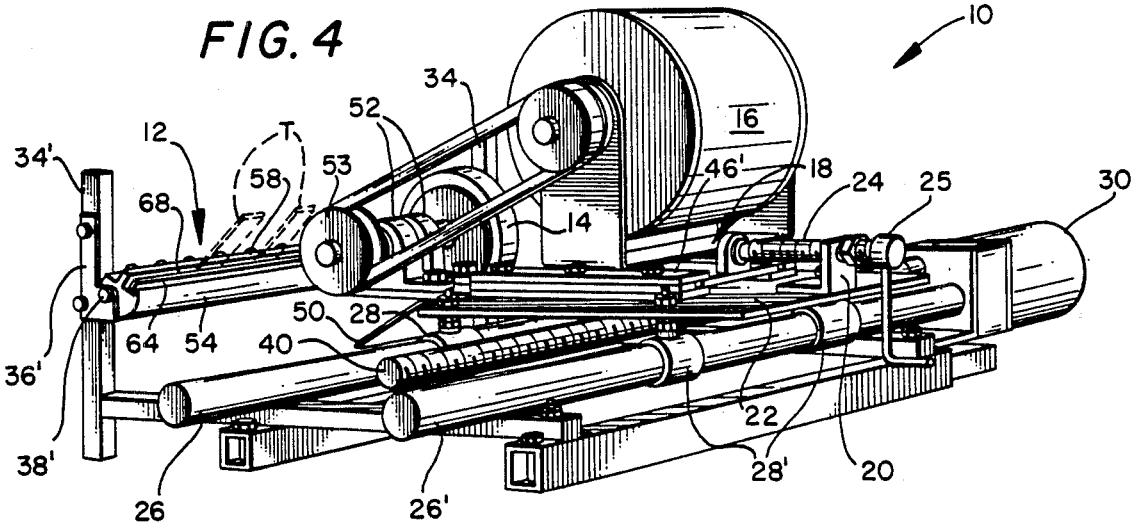
FIG. 4 is a perspective view showing the side opposite of the apparatus disclosed in FIG. 1.
Figure 5:
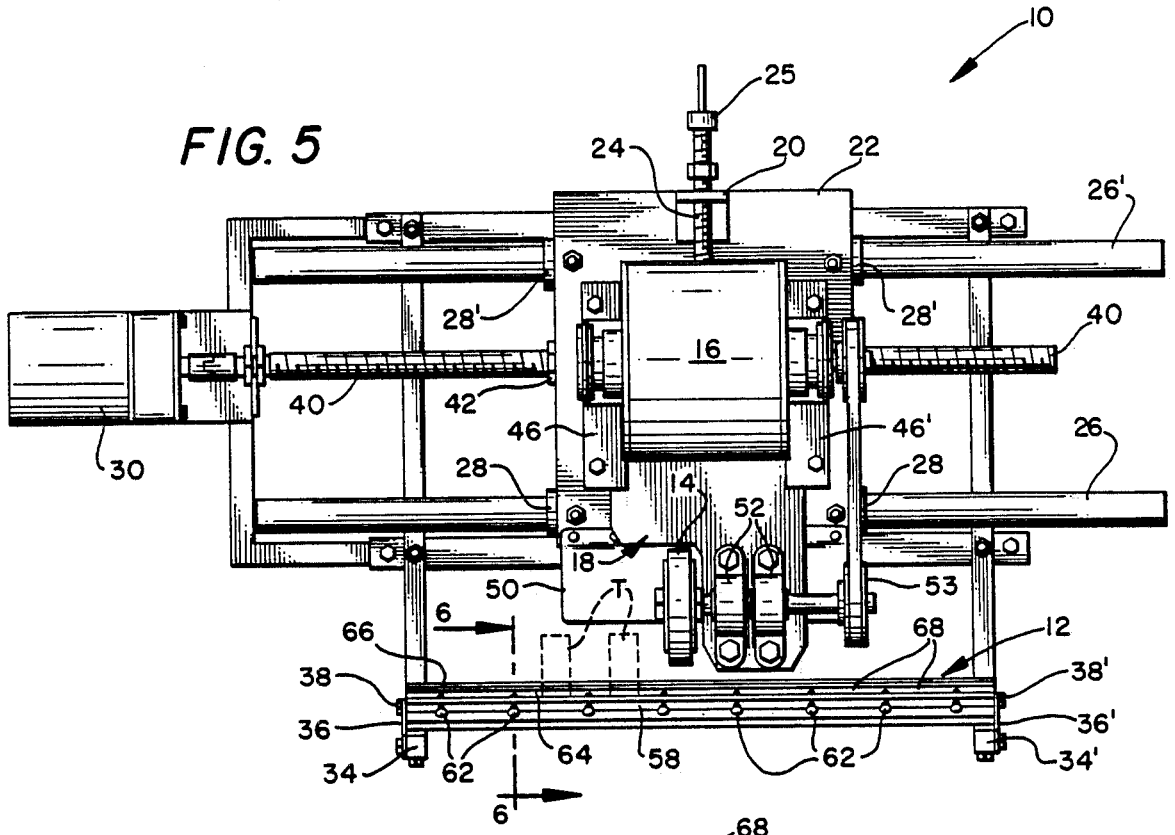
FIG. 5 is a top, plan view of the apparatus disclosed in FIGS. 1–4.
Figure 6:
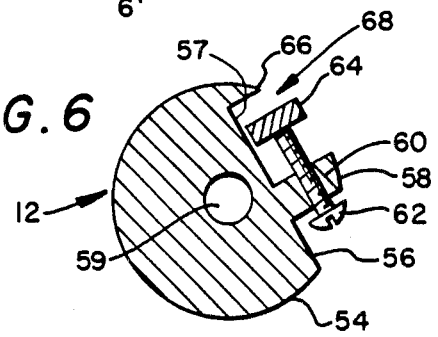
FIG. 6 is a cross-sectional view taken along line 6—6 of FIG. 5.

As seen in various different figures of the drawings, and in particular FIGS. 4–6, the tool bar or tool holder 12 has a main body portion 54, preferably circular in original cross-sectional configuration, which terminates in a flat at 56 and 57. The flats 56 and 57 are interrupted by the illustrated vertical flange 58. The flange is apertured and threaded at a plurality of locations as indicated by numeral 60, so that a threaded fastener 62 can be extended therethrough and into abutting engagement with a clamping bar 64. The circular part 54 of the tool bar terminates in a stop means at 66. The tool bar 12 preferably is fabricated from a 2" outside diameter solid bar by milling the flats 56 and 57 thereon, thereby leaving flange 58 and stop 66. Next, apertures 60 and 59 are formed into the flange and opposed ends, respectively, of the bar. As seen in FIG. 6, a packet 68 is formed between the clamping bar and stop means 66 so that various different configurations of chisels and other blade members can be easily and safely mounted in a removable manner within the tool bar.

Figure 8:
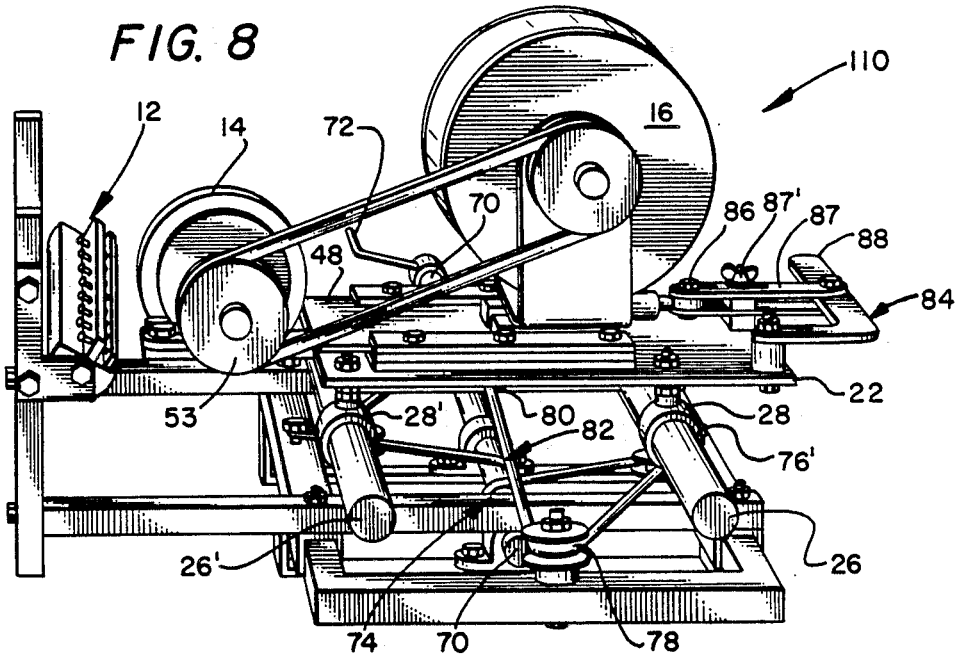
FIG. 8 is a perspective, side view of an alternant embodiment of the present invention; and, FIG. 9 is a diagrammatical, representation which sets forth part of the details of the apparatus disclosed in FIG. 8.
Figure 9:
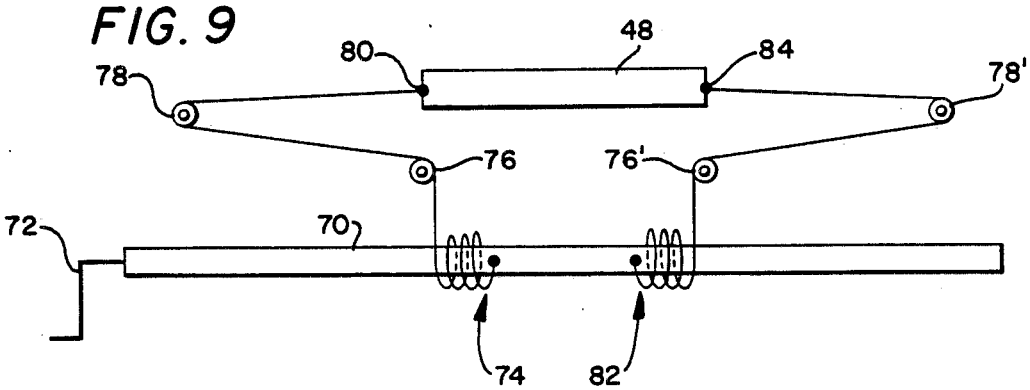

FIGS. 8 and 9 illustrate a second embodiment 110 of the invention. The second embodiment 110 of the invention is essentially of identical construction as the first embodiment 10, with the exception of the drive means by which the upper plate member 48 is moved longitudinally and laterally respective to the tool bar 12.

The apparatus for moving upper plate member 48 longitudinally of the tool bar 12 comprises a windlass 70 journaled between guide bars 26, 26'. The windlass 70 is rotated by a handle 72. Opposed ends of cable roved about the windlass in opposite directions, turns with one marginal end of the cabel extending several about a marginal length of the windlass 70, and then is roved through pulley 76, then through pulley 78, and into attached relationship at 80 respective to the upper plate member 48. The other marginal length 82 of the cable is similarly roved about the pulleys and connected back to the upper plate 48 at a location such as indicated by numeral 84. Rotation of the windlass in one direction drives the plate 48 in one direction along the tool bar, while rotation of the windlass in the opposite direction moves the plate in the other direction. Bell crank 84 is pivoted to the lower plate member and connected to the upper plate member by tie rod 86. Handle 88, when moved, imparts sliding movement into the upper plate member and thereby moves the grinding wheel towards the tool bar 12. Lock means 87 prevents relative movement between plate members 22 and 48.

In operation, a tool to be sharpened is placed between the jaws 66 and 64 of the tool bar 12 and captured therewithin by making up the threaded fastener 62. The cutting edges of all of the tools mounted on the tool bar are oriented in the same direction so that they each may be sequentially sharpened and dressed each pass of the rotating face of the grinding wheel 14 respective thereto. The surface of the grinding wheel is properly positioned in aligned relationship respective to the cutting face of the tool to be dressed. This is achieved by loosening the fastener 38 located at either end of the tool bar 12 and rotating the tool bar along its longitudinal axis. The abrasive face of the grinding wheel 14 is next positioned in proper alignment respective to the cutting face of the tool by manipulating handle 25. Manipulation of handle 25 slides the upper plate member 48 towards and away from the cutting edge of the tools T. Next, motor 30 is energized to turn the threaded shaft 40, thereby moving lower plate member 22 longitudinally respective to the tool bar, so that the properly oriented abrasive surface of the grinding wheel 14 sequentially contacts and dresses the cutting edge of each of the tools at the most optimum relative angle thereto. The motor 30 can be reversed after traveling across all of the faces of the tools T, and thereby provide a fine cut.

In the present invention, the sharp edge of the cutting tool is exposed to the operator's view rather than hidden, so that the operator of the apparatus 10 can closely monitor the grinding operation. The tool bar is uniquely designed to properly accept various different configurations of cutting tools that need dressing from time to time. One of the primary purposes achieved by this invention is the provision of a sharpening machine that is inexpensive and most anyone can use with very little mechanical aptitude. The tools received on the tool bar can often be mixed, that is, it is possible to sharpen a chisel, planer blade, jointer blade, and the like in a single operation.

The motor 30 is mounted in a manner to provide precise movement along a path which is parallel to the shaft thereof and also to the tool bar.

The movement of plates 22 and 48, together with the oscillatory movement of the tool bar 12, enables the abrasive surface of the grinding wheel to be placed in the most optimum position for providiing a superior cutting face on the various different tools to be dressed.

I claim:

1. Apparatus for sharpening the cutting face of a cutting implement comprising a main frame having spaced elongated guide members affixed thereto, spaced slide members attached to a first plate member and slidably received in captured relationship respective to said guide members so that said first plate member can be reciprocatingly moved in low friction relationship respective to said guide members;

a second plate member superimposed on said first plate member, spaced second guide members connecting the first and second plate members together in a manner to enable the second plate member to be mvoed in a direction which is perpendicular to the direction of movement of the first plate member; means for controlling the movement of said first and second plate members;

a grinder wheel, means mounting said wheel for rotation on said second plate member;

an elongated tool bar having opposed ends, bracket means by which the opposed ends of the tool bar are attached to said main frame with the axis thereof being parallel to the axis of the grinder wheel, and a fastener means by which the opposed ends of the tool bar is fastened to the bracket means in a manner whereby the tool bar can be rotated about the longitudinal axis thereof; means by which a pocket is formed within said tool bar, within which a plurality of cutting implements are arranged along a common line which extends parallel to the axis of the tool bar;

said tool bar is an elongated member having spaced parallel upper faces interrupted by spaced, parallel, longitudinal, vertical flange members, said flange members include an outer flange member that forms a stop and an inner flange member; a series of spaced threaded apertures formedd through said inner flange member, each aperture having a screw received therein and a central axis which lies in a plane which is parallel to the spaced faces;

a movable clamp member; a terminal end of each screw abuttingly engages one face of the movable clamp member; so that a pocket is formed between the confronting faces of the clamp member and the stop, within which an implement can be releasably received;

said guide members comprise a rod affixed to said frame, said slide members are in the form of a sleeve slidably captured about said rod;

said means for controlling the movement of said first and second plate members include a screw means, a threaded bracket attached to said first plate member, said screw means being threadedly affixed to said bracket and having a terminal end journaled to said second plate member so that rotation of the screw means moves the first and second plate members respectively to one another, with said second plate member being moved in a direction perpendicular to the tool bar;

whereby, axial rotation of the tool bar properly orients the cutting faces respective to the grinding wheel surface; movement of the second plate member brings the grinder wheel surface into contact with the cutting faces, while movement of the first plate member causes the rotating grinding wheel to move along and remove material from the cutting faces of each implement.

2. Tool sharpening apparatus for sharpening tools such as chisels, jointer blades, lawn mower blades, and the like comprising:

a main frame having spaced elongated guide members affixed thereto, a first plate member overlying said guide members, spaced slide members attached to said first plate member and slidably received in captured relationship respective to said guide members so that said first plate member can be reciprocatingly moved in low friction relationship respective to said guide members;

a second plate member superimposed on said first plate member, spaced second guide members connecting the first and second plate members together in a manner to enable the second plate member to be reciprocatingly moved in low friction relationship respective to the first plate member and in a direction which is perpendicular respective to the direction of movement of the first plate member; means for controlling the movement of said first and second plate members;

a grinding wheel, means mounting said wheel for rotation on said second plate member;

an elongated tool bar having opposed ends, bracket means by which the opposed ends of the tool bar are attached to said main frame, and a fastener means by which the opposed ends of the tool bar is fastened to the bracket means in a manner whereby the tool bar can be rotated about the longitudinal axis thereof; clamp means by which a plurality of tools to be sharpened can be removably affixed to the tool bar in a manner which positions the cutting faces of the tools along a line which is parallel to the axis of the tool bar;

said tool bar has spaced parallel faces interrupted by spaced, parallel, longitudinal, vertical flange members, said flange members include an outer flange member that forms a stop and an inner flange member; a series of spaced threaded apertures formed through said inner flange member, each aperture having a central axis which lies in a plane which is parallel to the spaced faces;

a movable clamp member; a threaded adjustment screw received through each aperture, the terminal end of each screw abuttingly engages one face of the movable clamp member; so that a pocket is formed between the confronting faces of the inner flange member and the stop, within which an implement can be releasably received;

whereby, movement of said second plate member moves the surface of the grinder wheel towards the cutting faces of the tools while movement of the first plate member moves the surface of the grinder along a path which is parallel to the tool bar axis and thereby sequentially engages and removes material from the cutting faces.

* * * * *

UNITED STATES PATENT AND TRADEMARK OFFICE

CERTIFICATE OF CORRECTION

PATENT NO. : 4,653,232

DATED : MARCH 31, 1987

INVENTOR(S) : ROSCOE C. FOREMAN

It is certified that error appears in the above-identified patent and that said Letters Patent is hereby corrected as shown below:

Column 4, line 1, substitute --lower-- for "plate";
Line 2, substitute --plate-- for "lower";
Line 35, substitute --pocket-- for "packet";
Line 36, insert --64-- after "bar";
Line 50, insert --a-- before "cable"; and insert --are-- before "roved";
Line 51, delete "turns";
Line 52, correct the spelling of "cable"; and insert --turns-- after "several";

Column 5, line 61, correct the spelling of "moved".

Signed and Sealed this

Fifteenth Day of September, 1987

*Attest:*

DONALD J. QUIGG

*Attesting Officer*

*Commissioner of Patents and Trademarks*